United States Patent [19]

von Poschinger-Camphausen

[11] Patent Number: 4,565,042

[45] Date of Patent: Jan. 21, 1986

[54] PLUG CONNECTION FOR BOARDS ABUTTING AT AN ANGLE

[76] Inventor: Florian von Poschinger-Camphausen, Froschhausen 33, 8110 Murnau/Obb., Fed. Rep. of Germany

[21] Appl. No.: 571,200

[22] Filed: Jan. 16, 1984

[30] Foreign Application Priority Data

Jan. 17, 1983 [DE] Fed. Rep. of Germany ..... 3301301
Mar. 22, 1983 [DE] Fed. Rep. of Germany ..... 3310370

[51] Int. Cl.[4] ..... E04C 1/14
[52] U.S. Cl. ..... 52/585; 446/122
[58] Field of Search ..... 52/36, 284, 286, 582, 52/585; 446/122, 124, 126

[56] References Cited

U.S. PATENT DOCUMENTS 228,052 5/1880 Frost ..... 52/585
1,308,254 7/1919 Otto ..... 446/122
1,671,505 5/1928 Bemis ..... 446/122
2,493,435 1/1950 Archambault ..... 446/124
3,987,579 10/1976 Palenik ..... 446/124

*Primary Examiner*—James L. Ridgill, Jr.
*Attorney, Agent, or Firm*—Morgan, Finnegan, Pine, Foley & Lee

[57] ABSTRACT

In articles formed from at least two boards in each of two planes and joined by plugs fitted into spaced holes formed in the faces of the boards in one plane and aligned holes in the ends of the boards of the other plane, the boards in each plane are of different width and arranged so that the adjacent edges of the boards in one plane are covered by a board in the other plane. The narrower boards are provided with at least two holes and the wider boards with at least three holes across their width, the spacing of all the holes being equal.

8 Claims, 10 Drawing Figures

PLUG CONNECTION FOR BOARDS ABUTTING AT AN ANGLE

The invention relates to boards connected at an angle, preferably a right-angle, to each other, of which at least one board is provided with spaced holes on a line across its face and at least one other board is provided in a planar edge with holes aligned therewith, connecting pins being frictionally held in the holes.

The joining of boards in the aforementioned manner is known and usually serves to make a permanent joint which is enhanced by additionally applying glue.

Plug connections are also known for boards in the manner of clamping building blocks wherein the boards are provided at the joints at their lateral edges with outwardly open rectangular recesses with a width corresponding to the board thickness so that the boards can be connected at the joints by pushing them together in an intersecting manner at the recesses. The intersected pushing together permits the desired number of boards to be arranged in each of the intersecting planes so that the known plug connection permits shelves to be constructed to the desired width from prefabricated boards, each board having at least two recesses at its end zones. However, the outer boards only have inwardly directed recesses.

The known plug connection only permits the construction of shelves of which the shape is prescribed by the length of the boards and by the recesses serving to make the joints. If any recesses that are provided are not used to make a connection, they would appear as eyesores in the finished shelf. In any case, the provision of the recesses is a relatively expensive procedure.

It is the problem of the invention to provide a plug connection for the boards that is simple to produce and provides more versatility in the manner of connecting the boards together.

According to the invention, this problem is solved in a connection of the aforementioned kind in that in the planes defined by the boards at an angle to one another boards of different width and substantially the same total width are arranged so that the boards in one plane cover the gap between the boards in the other plane, that the narrower boards are provided with at least two holes and the wider boards with at least three holes, and that the spacing of the holes in all the boards is equal and the spacing of the outer holes from the nearest board edges in the lines drawn through the holes is less than half the spacing of the holes from each other. In the plug connection according to the invention, the number and widths of boards in each plane are adapted to each other so that the boards in one plane cover the gaps between the boards in the other plane and the respective outer narrow side edges of the boards of both planes are substantially flush with each other. The width of the shelves or side walls is determined by the number of boards arranged in each plane and interconnected at their intersecting overlapping portions by at least one connecting pin. The connection according to the invention provides for equal divisions of holes, the gap remaining between the individual boards being freely selectable; it can in practice be kept so narrow that assembly without jamming is only just possible without any problem.

Since, because of their small diameter, the holes are not unsightly in the finished shelf even if they are not employed to make a connection, the boards can be provided with numerous rows of holes to permit the construction therefrom of shelves or the like according to different patterns. A particular advantage of the plug system according to the invention resides in the fact that the shelves or the like can be rebuilt or extended at will, it merely being necessary to add additional boards in the desired manner or to replace them after the introduction or withdrawal of connecting pins. The shelf system according to the invention can thus be varied subsequently in length, width, depth and shape by addition or replacement in any manner because the connecting pins are replaceable.

Desirably, at least one narrower board and one wider board are arranged in each of the planes defined by the boards extending at an angle to one another, the wider boards covering the gaps between the boards in the other plane. In this arrangement, the width of the shelves or side walls is determined by the number of wider boards arranged in each plane.

It is also possible to arrange only narrow or only wide boards in at least one of the planes defined by the boards extending at an angle to one another, provided that the total width of the boards is substantially equal and the boards in one plane cover the gaps between the boards in the other plane.

The connection according to the invention also permits boards to be connected in intersecting planes in that the holes pass through the faces of the boards and the boards having holes at the ends are placed over the connecting pins which project from both sides of the holes.

Additional advantageous embodiments of the invention have been described in the subsidiary claims.

Examples of the invention will now be described in more detail with reference to the drawing, wherein.

Figure 1:
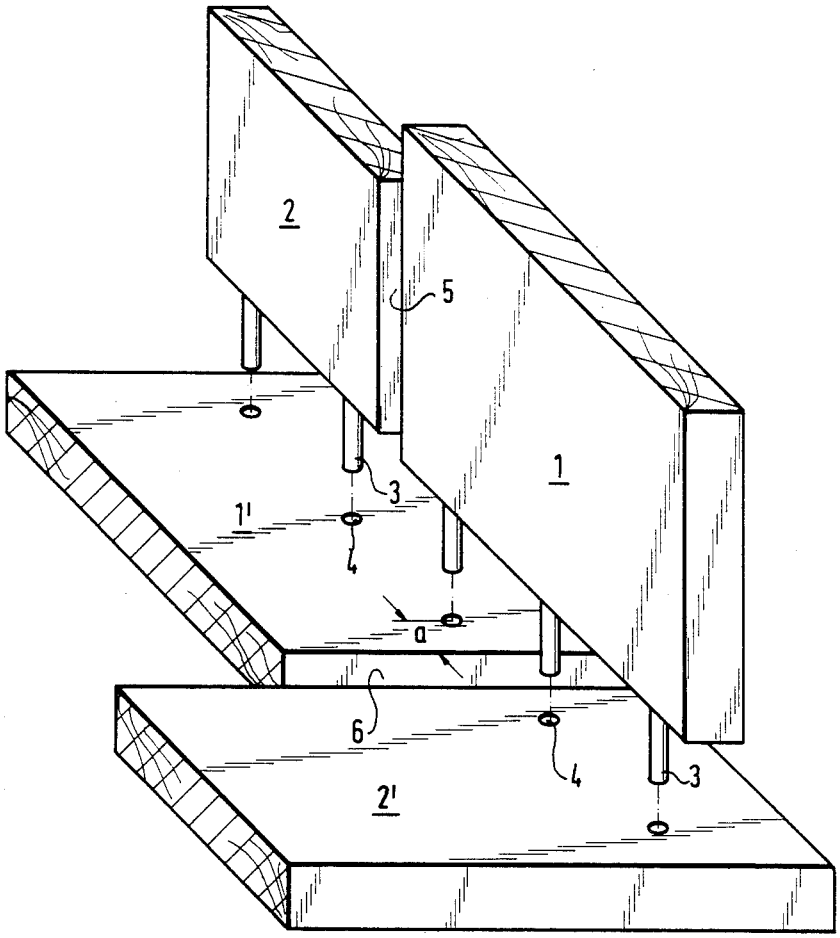
FIG. 1 is a perspective view prior to assembly of a right-angle connection between two narrow and two wider boards.
Figure 2:
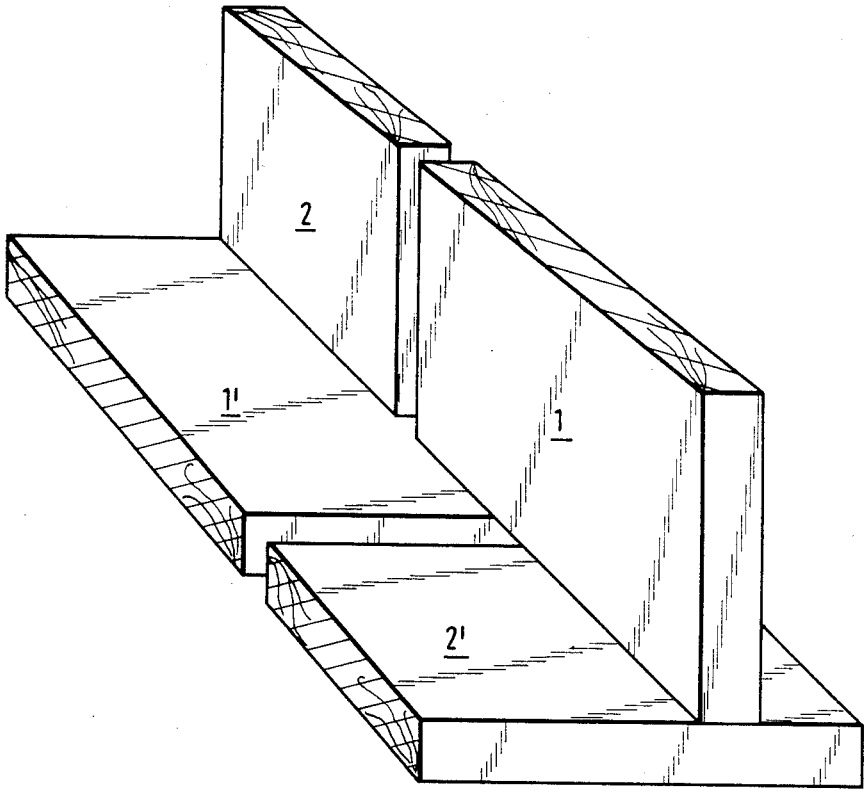
FIG. 2 is a perspective view of the FIG. 1 boards after assembly and interconnection.

In the connection according to FIGS. 1 to 4, wider boards 1, 1' and narrower boards 2, 2' are interconnected at right-angles by connecting pins 3. The boards 1', 2' are provided along a line transversely across the faces thereof with holes 4 which are respectively equally spaced from each other. The ends of the boards 1, 2 are provided on their centre lines with blind holes aligned with the holes 4 and into which connecting pins 3 of beech wood are frictionally inserted. To produce the angular connection, the connecting pins 3 projecting from the blind holes are pushed into the holes 4. The gaps 5, 6 between the boards 1, 2, and 1', 2' are respectively bridged by the wider boards 1, 1'. Since the holes and the connecting pins have equal spacings from each other, the same pitch is maintained in connections where there are more than two boards in one plane. The width of the gap between the boards can be selected by the remaining distance a between the outer holes and the edge of the board but this should be no more than half the pitch of the holes minus the hole radius.

Figure 3:
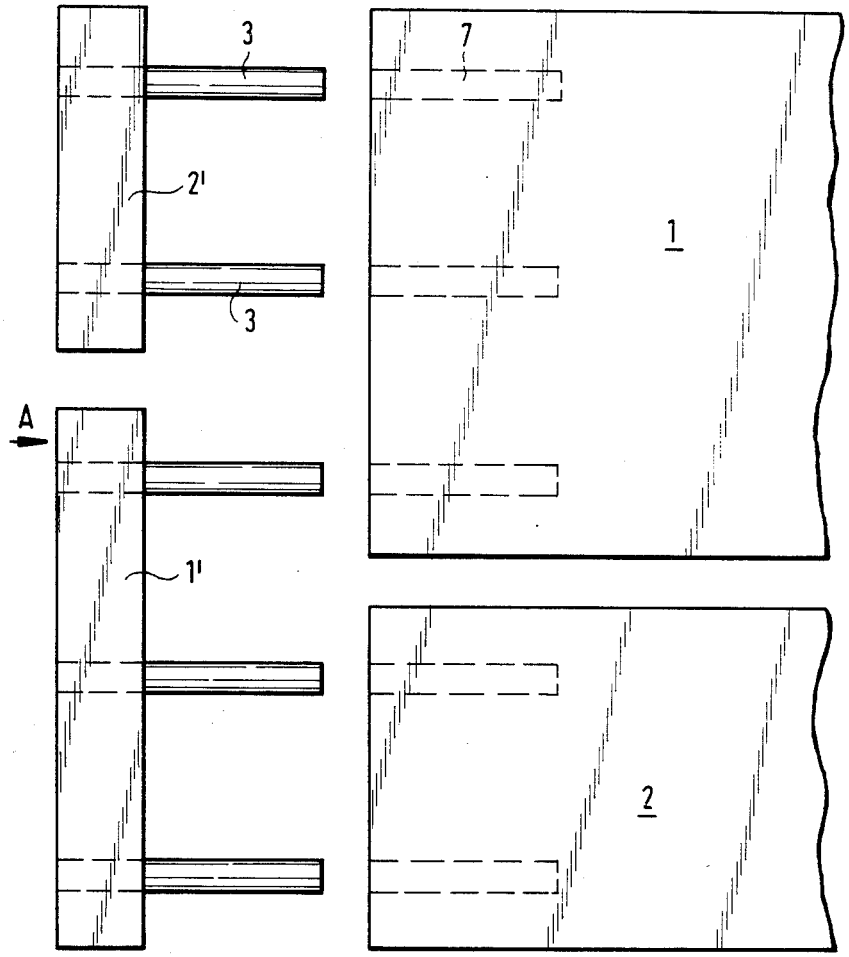
FIG. 3 is a side elevation of a connection according to FIG. 1.

In the example of FIG. 3, the connecting pins 3 are inserted in the holes 4 of boards 1' and 2'. For connection to the boards 1, 2, the pins are pushed into the blind holes 7 in the ends thereof.

Figure 4:
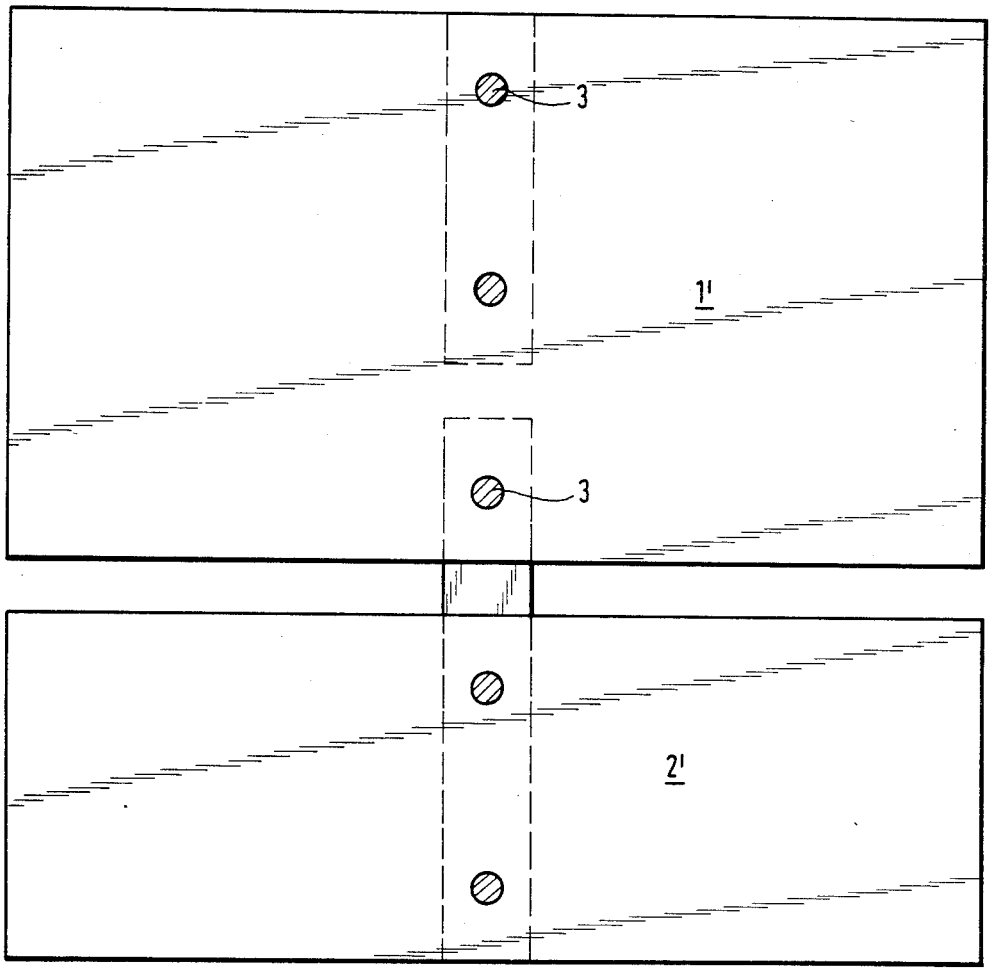
FIG. 4 is a plan view of the FIG. 3 connection taken in the direction of the arrow A.

FIG. 4 is a plan view of the interconnected boards of FIG. 3.

Figure 5:
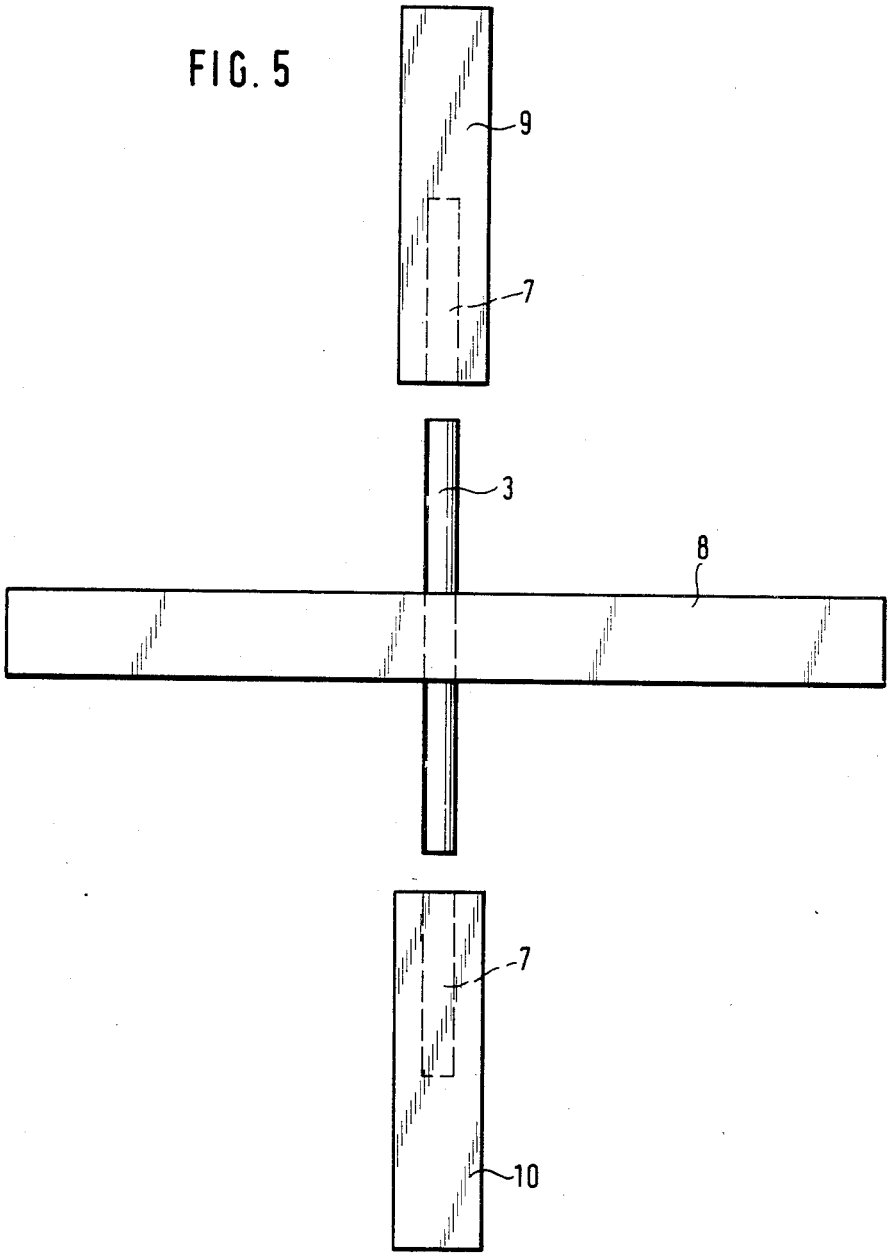
FIG. 5 is a side elevation of a connection of boards in planes intersecting at right-angles and FIGS. 6*a* to 6*e* show different possibilities of arranging narrower and wider boards in the intersecting planes.

In the connection of boards 8, 9, 10 in intersecting planes in accordance with FIG. 5, the connecting pins 3 pass through the board 8 in holes in such a way that the pins project beyond the board 8 on both sides. The boards 9, 10 to be joined thereto are then so pushed over the projecting ends of the connecting pins 3 in the illustrated manner that the projecting ends of the pins 3 are fully inserted in the blind holes 7 provided in the ends of boards 9, 10.

FIG. 6 illustrates different possibilities of arranging narrower and wider boards in intersecting planes.

The arrangement of FIG. 6*a* corresponds to the arrangement described with reference to FIG. 1.

Figures 6A, 6B, 6C, 6D, 6E:
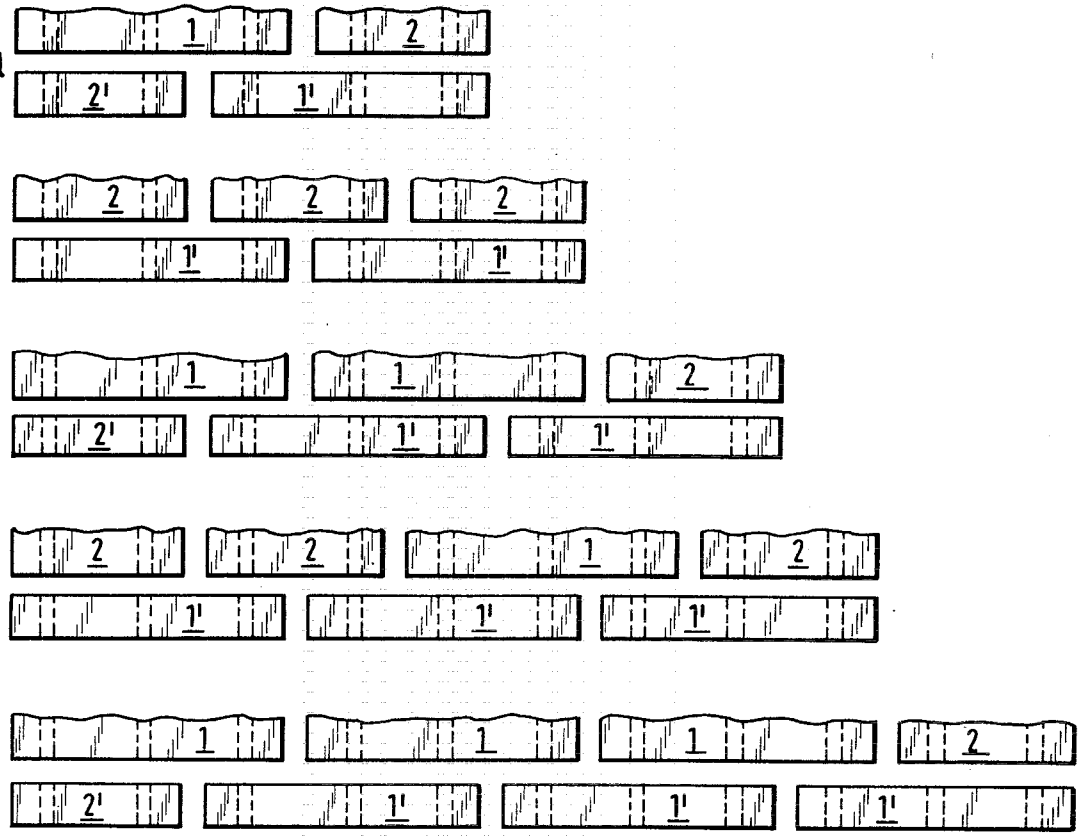

In the arrangement according to FIG. 6*b*, three narrow boards 2 are arranged in the vertical plane and two boards 1' in the horizontal plane to form, for example, a base. The width of the narrower boards is thus so adapted to the width of the wider boards that the total width of three narrow boards corresponds to the total width of two wider boards.

The FIG. 6*c* example constitutes an extension of the example of FIG. 6*a* in a manner such that an additional wider board 1, 1' is arranged in each plane.

The example of FIG. 6*d* can be regarded as an extension of the example of FIG. 6*b* insofar that a further wide board 1 or 1' is again arranged in each plane.

In the example of FIG. 6*e*, each plane contains three wide boards 1, 1' and one narrow board 2, 2'.

I claim:

1. Boards connected at an angle, preferably a right-angle, to each other and of which boards at least one is provided with spaced holes on a line across its face and at least one other board is provided in a planar edge with holes aligned with the holes of the first-mentioned board, and connecting pins being frictionally held in the holes of said boards, characterised in that in the planes defined by the boards at an angle to at least one of the other boards of different width and substantially the same total width are arranged so that the boards in one plane cover the gap between the boards in the other plane, the narrower boards being provided with at least two holes and the wider boards being provided with at least three holes and the spacing of the holes in all of the boards being equal and the spacing (a) of the outer holes from the nearest board edges in lines drawn through the holes being less than half the spacing of the holes from each other.

2. Boards according to claim 1, characterised in that in each plane defined by the boards extending at an angle to at least one of the other boards there is at least one narrower board and one wider board, the wider boards covering the gap between the boards in the other plane.

3. Boards according to claim 1, characterised in that only narrow boards or only wide boards are arranged in at least one of the planes defined by the boards extending at an angle to each other.

4. Boards according to claim 1, characterised in that the boards in one plane are replaced by a single wider board.

5. Boards according to claim 1, characterised in that the holes passing through the faces of the boards are provided with connecting pins projecting from both sides of the holes and the boards having holes in their ends are placed over said connecting pins on both sides of the provided therewith.

6. Boards according to claim 1, characterised in that the boards are of pine or spruce and the pins of beech.

7. Boards according to claim 1, characterised in that the boards consist of laths of plastics or sheet metal.

8. Boards according to claim 1, characterised in that the pins are of metal or platics.

* * * * *